US010141151B2

(12) United States Patent
Ziegler et al.

(10) Patent No.: US 10,141,151 B2
(45) Date of Patent: Nov. 27, 2018

(54) FUSE WITH SEPARATING ELEMENT

(71) Applicant: Robert Bosch GmbH, Stuttgart (DE)

(72) Inventors: Stefan Ziegler, Stuttgart (DE); Gergely Galamb, Traunstein (DE)

(73) Assignee: Robert Bosch GmbH, Stuttgart (DE)

( * ) Notice: Subject to any disclaimer, the term of this patent is extended or adjusted under 35 U.S.C. 154(b) by 26 days.

(21) Appl. No.: 14/905,881

(22) PCT Filed: Jun. 24, 2014

(86) PCT No.: PCT/EP2014/063205
§ 371 (c)(1),
(2) Date: Jan. 18, 2016

(87) PCT Pub. No.: WO2015/007462
PCT Pub. Date: Jan. 22, 2015

(65) Prior Publication Data

US 2016/0155596 A1 Jun. 2, 2016

(30) Foreign Application Priority Data

Jul. 16, 2013 (DE) ..... 10 2013 213 949

(51) Int. Cl.
*H01H 85/38* (2006.01)
*H01H 85/045* (2006.01)

(52) U.S. Cl.
CPC ..... *H01H 85/38* (2013.01); *H01H 85/0452* (2013.01); *H01H 2085/381* (2013.01); *H01H 2085/383* (2013.01); *H01H 2085/386* (2013.01)

(58) Field of Classification Search
CPC ..... H01H 85/0452; H01H 85/38; H01H 2085/381; H01H 2085/383; H01H 2085/386
USPC ..... 337/281
See application file for complete search history.

(56) References Cited

U.S. PATENT DOCUMENTS 2,734,110 A 2/1956 Jacobs
3,613,040 A * 10/1971 Fluder ..... H01H 9/443 218/24

(Continued)

FOREIGN PATENT DOCUMENTS

CN 101118824 A 2/2008
DE 2714797 2/1979

(Continued)

OTHER PUBLICATIONS

EPO machine translation of Kojima JP 2008300094.*

(Continued)

*Primary Examiner* — Anatoly Vortman
*Assistant Examiner* — Jacob Crum
(74) *Attorney, Agent, or Firm* — Michael Best & Friedrich LLP

(57) ABSTRACT

The invention relates to a safety device (1), comprising: a fusible member (2) having a first segment (3), a second segment (4), and a connecting segment (5), which connects the first segment (3) to the second segment (4). The safety device (1) further comprises a separation element (6), configured to suppress a light arc between the first segment (3) and the second segment (4). The first segment (3) of the fusible member (2) extends along a first side of the separation element (6), the second segment (4) of the fusible member (2) extends along a second side of the separation element (6) located opposite the first side, and the connecting segment (5) of the fusible member (2) extends along a third side of the separation element. It is thus achieved that a light arc between the first segment (3) and the second segment (4) of the fusible member (2) cannot exist even if the spatial distance between the first and the second segment (3, 4) of the fusible member (2) is so minimal that it allows a skipping of a light arc.

12 Claims, 4 Drawing Sheets

(56) References Cited

U.S. PATENT DOCUMENTS

| | | | | |
|---|---|---|---|---|
| 4,071,837 | A | 1/1978 | Ranzanigo | |
| 4,514,716 | A | 4/1985 | De Araujo | |
| 5,101,187 | A * | 3/1992 | Yuza | H01H 85/0417 337/255 |
| 5,130,688 | A | 7/1992 | Van Rietschoten et al. | |
| 5,140,294 | A * | 8/1992 | Rohrer | H01H 85/143 337/252 |
| 2004/0058586 | A1* | 3/2004 | Blutbacher | B60L 11/1881 439/660 |
| 2008/0100412 | A1* | 5/2008 | Lee | H01H 85/0458 337/225 |
| 2009/0027155 | A1* | 1/2009 | Arikawa | H01H 85/38 337/228 |
| 2009/0315664 | A1 | 12/2009 | Crane et al. | |
| 2011/0278041 | A1* | 11/2011 | Asplund | H01B 9/021 174/102 R |

FOREIGN PATENT DOCUMENTS

| | | |
|---|---|---|
| DE | 202012012570 | 6/2013 |
| JP | 11329206 | 11/1999 |
| JP | 2008300094 | 12/2008 |
| KR | 20040013718 | 2/2004 |
| WO | 0052724 | 9/2000 |
| WO | 2012123589 | 9/2012 |

OTHER PUBLICATIONS

International Search Report for Application No. PCT/EP2014/063205 dated Sep. 11, 2014 (English Translation, 3 pages).

* cited by examiner

FUSE WITH SEPARATING ELEMENT

BACKGROUND OF THE INVENTION

The present invention relates to a fuse with a separating element, in particular to a melting fuse for a vehicle battery.

In high-voltage vehicle batteries, high-voltage contactors are conventionally employed at the external vehicle terminals for the purpose of cutting out excess currents (up to about 1000-2000 A). For higher currents, fuses are built in, because contactors are no longer able to isolate such currents. Located in these fuses, depending on the type, is a fusible element (frequently made of copper) with cross-sectionally constricted portions. These cross-sectionally constricted portions or constrictions melt in the event of short-circuit currents. The higher the current or voltage, the longer an arc is able to remain in existence until it dies out. Fuses with several constrictions are therefore used for high voltages (currently about 450 V) and currents (currently about 8 kA). In this way, at each constriction a clearance arises which in total has to be overcome by individual arcs. The length of the fuse is consequently determined by the maximum voltage and the maximum current. Fuses are conventionally filled with sand, which is responsible for the arc dying out as quickly as possible.

Such a fuse according to the state of the art is shown in FIG. 3. Said fuse includes a fusible element 11 with several constrictions 12 at which the conductive cross section of the fusible element 11 has been reduced. The two ends 13 and 14 of the fusible element 11 are suitable to integrate the fuse 10 into an electric circuit. At least the constrictions 12 are surrounded by a fuse housing 15. In the case of a short circuit in the electric circuit into which the fuse has been integrated, a high current flows across the fusible element 11. The latter begins to melt and, as a result, is firstly interrupted at one of the constrictions 12. By virtue of the voltage applied to the fuse 10, an arc may occur between the interrupted portions of the fusible element 11. By virtue of the current consequently continuing to flow through the fusible element 11, the latter is also interrupted at the further constrictions 12 by melting of the fusible element 11. This process continues until at least so many constrictions 12 of the fusible element 11 have fused that the distance to be bridged by arcs within the fuse 10 is so great that a breaking of the arcs occurs. Since the maximum length of the distance to be bridged by arcs is dependent on the number of constrictions 12 of the fusible element 11, it is necessary to form such a fuse 10 according to the state of the art to be appropriately long.

A fuse according to the state of the art is presented in JPH11329206A. Described in the latter is a fuse in which a path to be bridged by an arc in the case of a tripped fuse is lengthened by means of a magnetic field generated by two magnets.

A further fuse according to the state of the art is presented in US2009315664A. A rapid interruption of a current is obtained in the fuse presented in this document by virtue of the fact that a fusible element is pressed between insulating separating plates by an induced magnetic field.

A further fuse according to the state of the art is presented in WO12123589A. In the latter, a fuse and a process for producing a fuse are described. The fuse includes means for influencing an electromagnetic field of a fusible element.

A fuse base according to the state of the art is presented in KR20040013718A. The fuse base that is described includes two magnets. The magnetic field caused by these magnets has been configured to prevent an appearance of arcs when inserting or taking out a fuse.

Since batteries with such fuses are employed especially in the automotive field, a design of the fuse is desirable that is as compact as possible.

SUMMARY OF THE INVENTION

The fuse according to the invention includes a fusible element with a first portion, with a second portion, and with a connecting portion which connects the first portion to the second portion. The fuse further includes a separating element which has been configured to prevent an arc between the first portion and the second portion. The first portion of the fusible element extends on a first side of the separating element, the second portion of the fusible element extends on a second side of the separating element, which is situated opposite the first side, and the connecting portion of the fusible element extends on a third side of the separating element. Hence it is ensured that an arc between the first portion and the second portion of the fusible element is interrupted/prevented by the separating element, despite the spatial proximity of the first portion and the second portion. Consequently a compact design of the fuse is made possible.

In particular, in a fuse according to the invention in each instance a part of the first portion and of the second portion of the fusible element projects beyond the separating element, and the first portion of the fusible element has been connected to the second portion of the fusible element in this region via the connecting portion. In this way, the connecting portion may be very short and is optimally supported by the first portion and the second portion, as a result of which an improved stability with respect to mechanical influences on the fuse is obtained.

It is advantageous if the connecting portion of the fusible element has been configured to melt temporally ahead of the first portion and ahead of the second portion in the event of a high current through the fusible element. Hence a shortened process of tripping the fuse in a case of a short circuit at a predefined place is made possible. By virtue of the fact that a flow of current in the first portion and in the second portion runs respectively in an opposing direction, the first portion and the second portion repel one another in the event of a high excess current. As soon as the connecting portion no longer mechanically stabilizes the first portion and the second portion of the fusible element, and the sections are consequently no longer maintained at the same separation, the spacing between the first portion and the second portion increases by virtue of the Lorentz force, and consequently a distance that has to be bridged by the arc also increases. As a result, the arc is extinguished more quickly.

Moreover, it is advantageous to arrange in the region of the connecting portion at least one field-generating device for generating a magnetic field, which gives rise to a magnetic field in the region of the connecting portion. In this way, the region in which an arc forms in the case of a short circuit can be influenced. The arc can consequently be influenced in such a manner that a rapid breaking of the arc occurs.

For this purpose the magnetic field may have been directed in such a manner that an arc, caused by a current, between the first portion and the second portion is directed away from the separating element. Hence an arc can be prevented from extending along the separating element after a part of the fusible element has melted. The reaction-time of the fuse is therefore shortened. In addition, in the case of a short circuit the magnetic field provides for a repulsion of the first portion and the second portion from one another, so that the distance that has to be bridged by the arc increases by virtue of a displacement, directed away from the separating element, of the first portion and the second portion, and the arc is extinguished more quickly.

Alternatively, it is advantageous if the magnetic field has been directed in such a manner that an arc, caused by a current, between the first portion and the second portion is directed toward the separating element. As a result, the arc comes into contact with the separating element earlier and is interrupted earlier by the separating element. The reaction-time of the fuse is therefore shortened.

Moreover, it is advantageous if the separating element consists of a ceramic. This material exhibits both good insulating properties and a high thermal resistance. Hence it is particularly well suited for interrupting an arc.

In particular, the fuse is suitable for a voltage range up to 1 kV, in particular for a voltage range between 430 V and 470 V, or for separating a current of up to 10 kA, in particular a current between 7 kA and 9 kA. Especially within these ranges of voltage and current, high-energy arcs arise in fuses. In addition, these voltages and currents are no longer isolated by conventional battery contactors. Hence by virtue of the fuse according to the invention a compact and cost-effective alternative element for interrupting a corresponding voltage or current is provided here.

According to a further aspect of the present invention, a traction battery is proposed having a fuse as described in detail above. Especially in mobile applications the requirements as regards a compact and lightweight structural design of fuses are stringent. Hence the fuse according to the invention is especially advantageous in the case of a traction battery.

BRIEF DESCRIPTION OF THE DRAWINGS

An embodiment of the invention will be described in detail with reference to the accompanying drawing. In the drawing.

DETAILED DESCRIPTION

Figure 1:
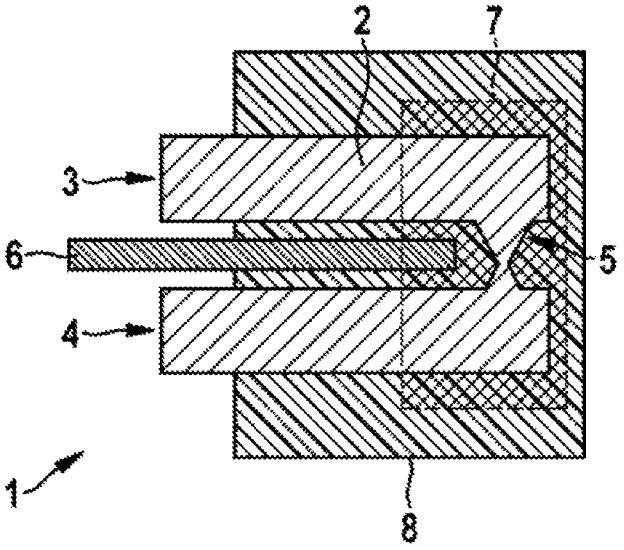
FIG. 1 is a schematic view of a cross section through a fuse according to the embodiment of the invention.

FIG. 1 shows a schematic view of a cross section through a fuse 1 according to an embodiment of the invention. The fuse 1 includes a fusible element 2 with a first portion 3, with a second portion 4, and with a connecting portion 5. The material of the fusible element has been chosen in such a way that the latter is both electrically conductive and, in the event of high currents, is heated up in such a manner that its melting-point is exceeded. In the embodiment shown here, the fusible element 2 consists of copper.

The fuse further includes a separating element 6 which has been configured to prevent an arc between the first portion 3 and the second portion 4. An arc may arise, in particular, in the case of a short circuit, and is able to bridge an air gap in the fusible element 2. The separating element 6 therefore consists of ceramic, in order to offer a high insulation resistance and a high thermal resistance.

The connecting portion 5 and a part of the first and second portions 3 and 4 that is situated on the side of the connecting portion 5, and also a portion of the separating element 6, are surrounded by a fuse housing 8.

The first portion 3 of the fusible element 2 extends on a first side of the separating element 6. The second portion 4 of the fusible element 2 extends on a second side of the separating element 6, which is situated opposite the first side. The separating element 6 has accordingly been arranged spatially between the first portion 3 and the second portion 4 of the fusible element 2. The separating member 6 in this embodiment has the shape of a plate. The plate has two opposing large-area sides and four peripheral sides with a smaller surface area. The first portion 3 and the second portion 4 of the fusible element 2 are respectively situated in the direction of the large-area sides of the separating element 6. In the direction of one of the sides with smaller surface area the first portion 3 and the second portion 4 project beyond the large-area sides of the plate or, to be more precise, of the separating element 6. Accordingly, in this region no separating element 6 is situated between the first and second portions 3 and 4. In this region the two portions 3 and 4 have been connected to one another by the connecting portion 5 of the fusible element 2. The connecting portion 5 of the fusible element 2 consequently extends on a third side of the separating element 6.

The connecting portion 5 is smaller in its conductive cross section than the first and second portions 3 and 4 of the fusible element 2.

By virtue of the fact that the separating element 6 has been constructed in the form of a plate, and the separating element 6 has a high electrical resistance, a path described by a least resistance between an arbitrary point of the first portion and an arbitrary point of the second portion is lengthened by the separating element. This does not apply to the regions of the first portion 3 and of the second portion 4 that project beyond the large-area sides of the plate or of the separating element 6.

The first portion and the second portion of the fusible element 2 respectively project outward at their ends situated opposite the connecting portion 5 on one side of the fuse housing 8. These projecting ends of the fusible element 2 serve as terminal contacts of the fuse 1. At these contacts the fuse is integrated into an electric circuit to be protected. Also in this region, which is situated outside the fuse housing 8, the separating element 6 has been arranged between the large-area sides of the separating element 6. The separating element 6 projects further out of the fuse housing than the first and second portions 3 and 4 of the fusible element 2. As a result, a spark-over of the arc outside the fuse housing is also prevented.

Figure 4:
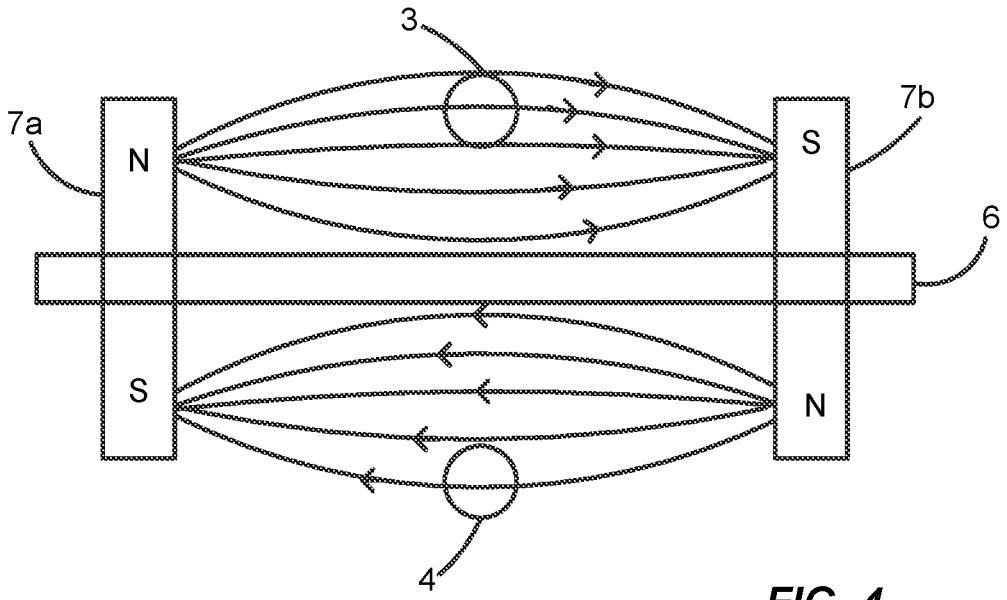
FIG. 4 is a schematic view of a cross section through a fuse according to an embodiment of the invention.
Figure 5:
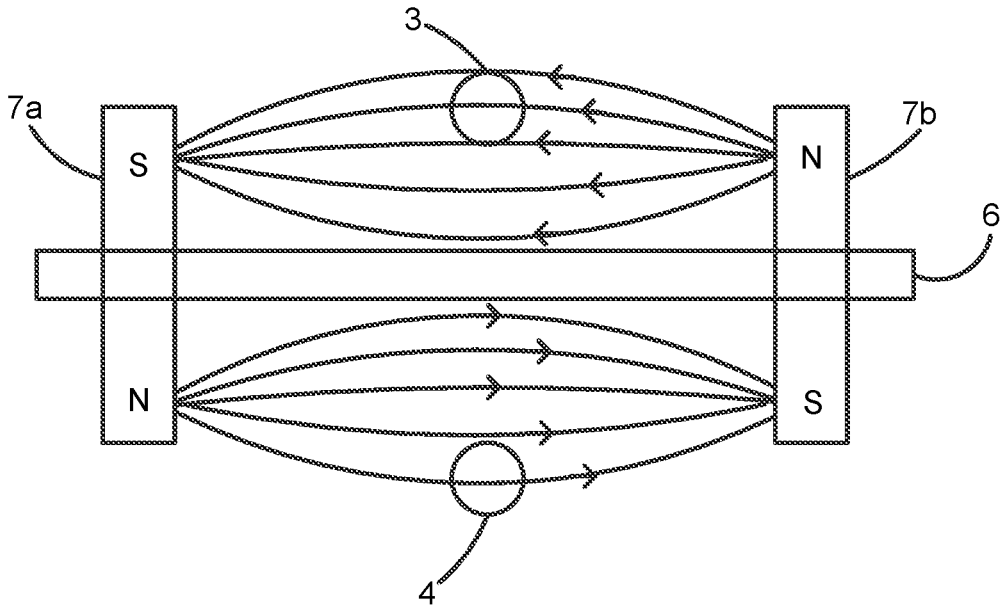
FIG. 5 is a schematic view of a cross section through a fuse according to an embodiment of the invention.
Figure 4A:
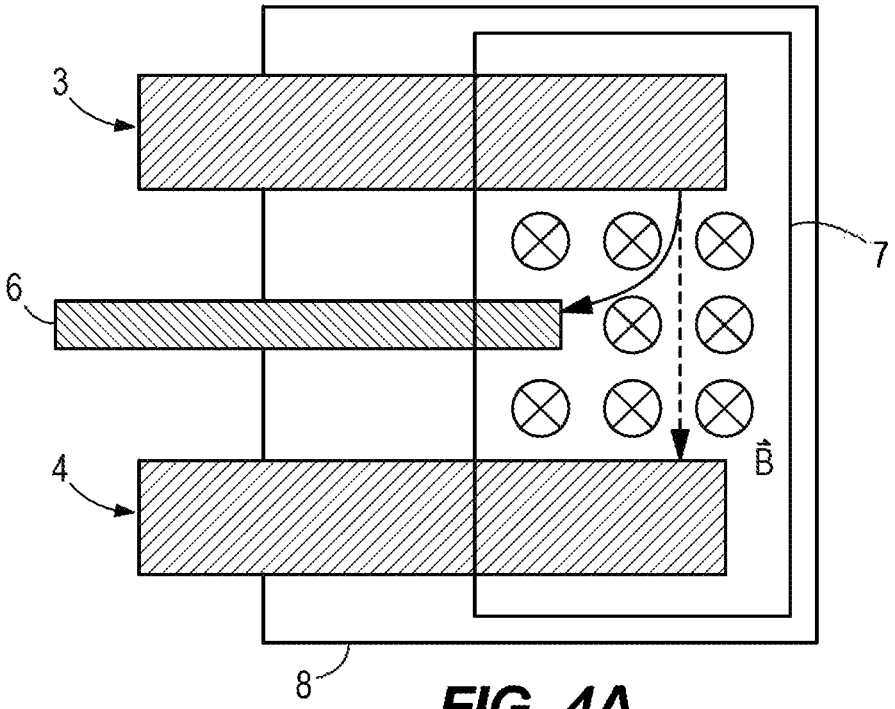
FIG. 4A is a schematic view of a cross section through a fuse according to an embodiment of the invention, illustrating a magnetic field and an arc that is directed toward a separating element.
Figure 5A:
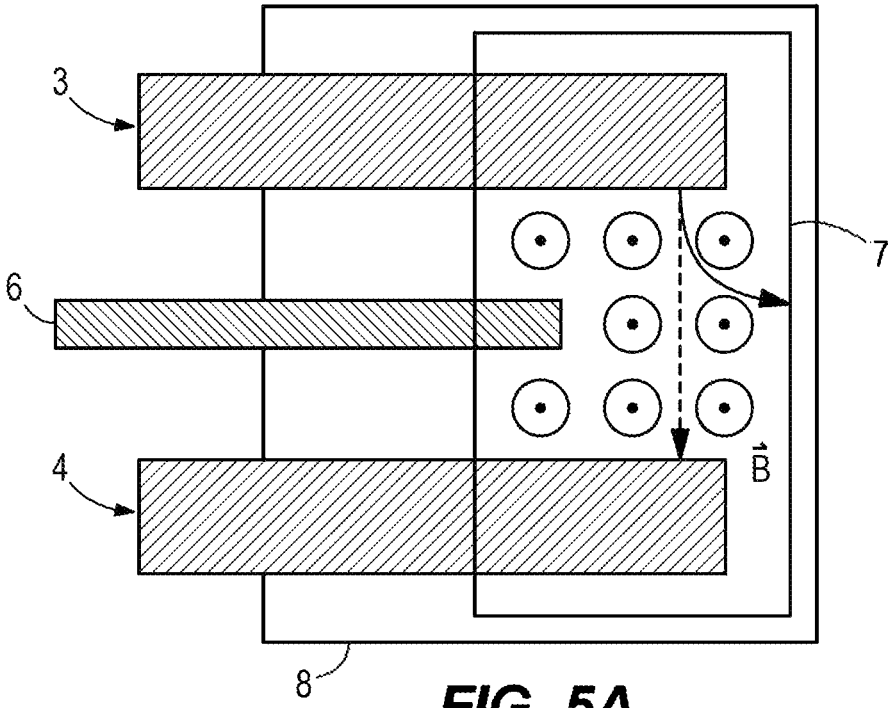
FIG. 5A is a schematic view of a cross section through a fuse according to an embodiment of the invention, illustrating a magnetic field and an arc that is directed away from a separating element.

In the region of the connecting portion 5 two permanent magnets 7 have been arranged by way of field-generating devices for generating a magnetic field, as illustrated by FIGS. 4 and 5. The two permanent magnets 7 have been arranged on either side of the fusible element 2. Since in FIG. 1 which is shown it is a question of a cross section through the fuse 1, only one of the permanent magnets 7 is apparent. As illustrated in FIGS. 4 and 5, depending on the polarity of the permanent magnets 7, in the region between the permanent magnets 7 the arc is directed toward the separating element 6 or away from the separating element 6. Both orientations of the permanent magnets 7 are advantageous. If the arc is directed toward the separating element 6, it is interrupted by the latter. If the arc is directed away from the separating element 6, the distance to be bridged by the arc is lengthened, and in this way the arc is interrupted. In addition, the first portion 3 and the second portion 4 are repelled by the Lorentz force in the case of a short circuit, and the distance to be bridged by the arc is enlarged further by a displacement of the portions.

Figure 2:
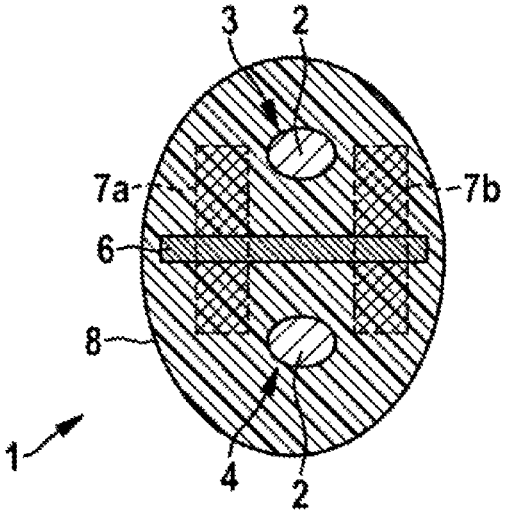
FIG. 2 is a further schematic view of a cross section through a fuse according to the embodiment of the invention.
Figure 3:
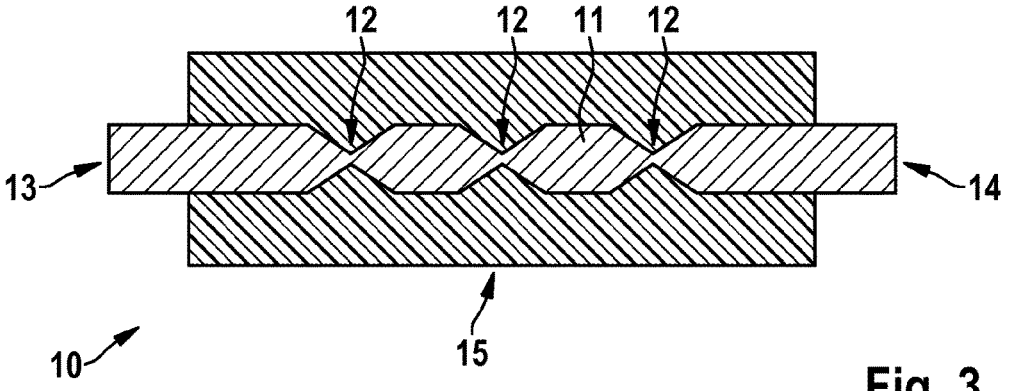
Fig. 3 PRIOR ART
FIG. 3 is a schematic view of a cross section through a fuse according to the state of the art.

FIG. 2 shows the fuse 1, which is also shown in FIG. 1, in a further cross section. In this case the arrangement of the first portion 3 and the second portion 4 of the fusible element 2 on the opposing sides of the separating element 6 is likewise apparent. It also becomes apparent here, and in FIGS. 4 and 5, that two permanent magnets 7 *a* and 7 *b* have been arranged on opposite sides of the fusible element 2.

If a short circuit occurs in the electric circuit into which the fuse 1 has been integrated, a high current flows through the fusible element 2 via the terminal contacts. As a result, the fusible element 2 is heated up and begins to melt. Since the conductive cross section of the fusible element 2 is smallest at the connecting section 5, the fusible element is firstly separated by the melting process in this region. Since initially only a small air gap arises in the fusible element 2, the arc is able to flash over between the not yet molten parts of the separating element. By virtue of the magnetic field of the permanent magnets, this arc is directed toward the separating element 6. Since the latter consists of an insulating ceramic, the arc is severed. The electric circuit is consequently interrupted by the fuse 1.

By virtue of the fact that in the event of a short circuit the arc no longer has to be extinguished by the lengthening of the clearance as a result of the fusible element 2 melting away, but rather the direct path of the arc is interrupted by the separating element 6, significantly fewer constrictions have to be built in. In this regard, the constrictions of a previously described fuse according to the state of the art can be compared with the connecting portion 5 of fuse 1. When the connecting portion 5 is melting away, the arc can no longer remain directly between the first portion 3 and the second portion 4 of the fusible element 2. The clearance between the two poles is significantly lengthened by the separating element.

Depending on the orientation of the poles of the permanent magnets 7*a* and 7*b*, the current is directed outward (away from the separating element 6) or inward (toward the separating element 6) by the Lorentz force. If the current is directed outward, this lengthens the clearance to be bridged. The arc possibly does not touch the separating element 6. If the current is directed inward, the arc is separated by the separating element 6. To this end, the separating element must be designed to be sufficiently stable and heat-resistant.

What is claimed is:

1. A fuse (1) comprising:

a U-shaped fusible element (2) with a first portion (3), a second portion (4) generally parallel to the first portion (3), and a connecting portion (5) which connects the first portion (3) to the second portion (4), such that the first portion (3), the second portion (4), and the connecting portion (5) define a plane, a separating element (6) which is configured to prevent an arc between the first portion (3) and the second portion (4), a first field-generating device (7*a*) for generating a first magnetic field in the region of the connecting portion (5), and a second field-generating device (7*b*) for generating a second magnetic field in the region of the connecting portion (5), wherein the first and second field-generating devices (7*a*, 7*b*) are permanent magnets, wherein the first portion (3) of the fusible element (2) extends on a first side of the separating element (6), wherein the second portion (4) of the fusible element (2) extends on a second side of the separating element (6), which is situated opposite the first side, wherein the connecting portion (5) of the fusible element (2) extends on a third side of the separating element (6), wherein the first and second field-generating devices (7*a*, 7*b*) are positioned on opposite sides of the fusible element (2) and on opposite sides of the plane, and wherein the first and second magnetic fields are directed in such a manner that an arc, caused by a current, between the first portion (3) and the second portion (4) is directed toward the separating element (6).

2. The fuse (1) as claimed in claim 1, characterized in that in each instance a part of the first portion (3) and of the second portion (4) of the fusible element (2) projects into a region beyond the separating element (6), and the first portion (3) of the fusible element (2) and the second portion (4) of the fusible element (2) are connected to one another in this region via the connecting portion (5).

3. The fuse (1) as claimed in claim 1, characterized in that the connecting portion (5) of the fusible element (2) is configured to melt temporally ahead of the first portion (3) and ahead of the second portion (4) in the event of a high current through the fusible element (2).

4. The fuse (1) as claimed in claim 1, characterized in that the separating element (6) comprises a ceramic.

5. The fuse (1) as claimed in claim 1, characterized in that the fuse (1) is configured for a voltage range up to 1 kV.

6. The fuse (1) as claimed in claim 1, characterized in that the fuse (1) is suitable for separating a current of up to 10 kA.

7. A vehicle battery with a fuse (1) as claimed in claim 1.

8. The fuse (1) as claimed in claim 1, characterized in that the fuse (1) is configured for a voltage range between 430 V and 470 V.

9. The fuse (1) as claimed in claim 1, characterized in that the fuse (1) is suitable for separating a current between 7 kA and 9 kA.

10. The fuse as claimed in claim 1, wherein the first and second field-generating devices (7*a*, 7*b*) are arranged in the region of the third side of the separating element (6), wherein the first and second field-generating devices (7*a*, 7*b*) extend parallel to the plane of the fusible element (2), and wherein the first and second field-generating devices (7*a*, 7*b*) extend from the first side of the separating element (6) to the second side of the separating element (6).

11. The fuse (1) as claimed in claim in claim 1, wherein the first and second field-generating devices (7*a*, 7*b*) extend parallel to the plane from the first side of the separating element (6) to the second side of the separating element (6), and wherein the first and second field-generating devices (7*a*, 7*b*) are each spaced from the fusible element (2) in a direction that is perpendicular to the plane.

12. The fuse as claimed in claim 11, wherein the first and second field-generating devices (7*a*, 7*b*) are arranged in the region of the third side of the separating element (6), wherein the first and second field-generating devices (7*a*, 7*b*) extend parallel to the plane of the fusible element (2), and wherein the first and second field-generating devices (7*a*, 7*b*) extend from the first side of the separating element (6) to the second side of the separating element (6).

* * * * *